US009725677B2

(12) United States Patent
Aoyagi et al.

(10) Patent No.: US 9,725,677 B2
(45) Date of Patent: Aug. 8, 2017

(54) CLEANER COMPOSITION

(71) Applicant: JX NIPPON OIL & ENERGY CORPORATION, Tokyo (JP)

(72) Inventors: Ko Aoyagi, Tokyo (JP); Mizuho Yoshida, Tokyo (JP); Koichiro Kai, Tokyo (JP); Hiroe Otsuka, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 39 days.

(21) Appl. No.: 14/785,654

(22) PCT Filed: Apr. 23, 2014

(86) PCT No.: PCT/JP2014/061481

§ 371 (c)(1),
(2) Date: Oct. 20, 2015

(87) PCT Pub. No.: WO2014/175353

PCT Pub. Date: Oct. 30, 2014

(65) Prior Publication Data

US 2016/0090550 A1 Mar. 31, 2016

(30) Foreign Application Priority Data

Apr. 25, 2013 (JP) ..... 2013-092876

(51) Int. Cl.
*C11D 1/83* (2006.01)
*C11D 1/28* (2006.01)
(Continued)

(52) U.S. Cl.
CPC ..... *C11D 1/83* (2013.01); *C11D 1/123* (2013.01); *C11D 1/28* (2013.01); *C11D 1/667* (2013.01);
(Continued)

(58) Field of Classification Search
CPC ..... C11D 17/0021
See application file for complete search history.

(56) References Cited

U.S. PATENT DOCUMENTS 4,749,516 A 6/1988 Brusky
5,249,446 A * 10/1993 Biresaw ..... B21D 22/201 29/890.03
(Continued)

FOREIGN PATENT DOCUMENTS

CN 102732394 10/2012
EP 0 418 986 3/1991
(Continued)

OTHER PUBLICATIONS

International Search Report issued Aug. 5, 2014 in International Application No. PCT/JP2014/061481.
(Continued)

*Primary Examiner* — Gregory Webb
(74) *Attorney, Agent, or Firm* — Wenderoth, Lind & Ponack, L.L.P.

(57) ABSTRACT

A cleaner composition includes: a saturated aliphatic hydrocarbon (A); an anionic surfactant (B); a nonionic surfactant (C); and water (D). The cleaner composition contains the saturated aliphatic hydrocarbon (A) in a proportion of 60.0% by mass to 85.0% by mass, the anionic surfactant (B) in a proportion of 8.0% by mass to 15.0% by mass, the nonionic surfactant (C) in a proportion of 2.0% by mass to 5.0% by mass, and the water (D) in a proportion of 1.0% by mass to 20.0% by mass, forms a W/O microemulsion or a solubilized W/O emulsion, and has a volume resistivity of $1\times10^9$ Ω·cm or less.

11 Claims, 1 Drawing Sheet

(51) Int. Cl.

| | |
|---|---|
| ***C11D 3/18*** | (2006.01) |
| ***C23G 5/06*** | (2006.01) |
| ***C11D 17/00*** | (2006.01) |
| ***C11D 1/66*** | (2006.01) |
| ***C11D 1/12*** | (2006.01) |

(52) U.S. Cl.

CPC ..... *C11D 3/18* (2013.01); *C11D 3/181* (2013.01); *C11D 17/0021* (2013.01); *C23G 5/06* (2013.01)

(56) References Cited

U.S. PATENT DOCUMENTS

| | | | | |
|---|---|---|---|---|
| 5,277,836 | A | 1/1994 | Peters | |
| 5,663,135 | A | 9/1997 | D'Muhala et al. | |
| 5,814,594 | A | 9/1998 | Vlasblom | |
| 5,817,186 | A | 10/1998 | D'Muhala et al. | |
| 7,417,018 | B2 | 8/2008 | Michaud et al. | |
| 8,722,605 | B2 * | 5/2014 | Wilson | 134/40 |

FOREIGN PATENT DOCUMENTS

| | | |
|---|---|---|
| EP | 0 780 467 | 6/1997 |
| JP | 62-96600 | 5/1987 |
| JP | 3-207799 | 9/1991 |
| JP | 6-502202 | 3/1994 |
| JP | 8-173787 | 7/1996 |
| JP | 9-125093 | 5/1997 |
| JP | 9-125099 | 5/1997 |
| JP | 9-157698 | 6/1997 |
| JP | 9-176700 | 7/1997 |
| JP | 2001-523754 | 11/2001 |
| JP | 2002-97493 | 4/2002 |
| JP | 2002-241793 | 8/2002 |
| JP | 2002-256285 | 9/2002 |
| JP | 2002-322495 | 11/2002 |
| JP | 2003-73692 | 3/2003 |
| JP | 2003-247160 | 9/2003 |
| JP | 2004-143409 | 5/2004 |
| JP | 2004-189821 | 7/2004 |
| JP | 2004-525753 | 8/2004 |
| JP | 2005-154644 | 6/2005 |
| JP | 2006-225489 | 8/2006 |
| JP | 2007-31692 | 2/2007 |
| JP | 2008-49235 | 3/2008 |
| JP | 2010-174106 | 8/2010 |
| JP | 2011-132302 | 7/2011 |
| WO | 92/07058 | 4/1992 |
| WO | 96/38522 | 12/1996 |

OTHER PUBLICATIONS

Office Action mailed Jun. 21, 2016 in Japanese patent application No. 2013-092876 (with English translation).

Decision to a Patent Grant mailed Sep. 20, 2016 in corresponding Japanese patent application No. 2013-092876 with English translation.

First Office Action dated May 3, 2017 in corresponding Chinese Application No. 201480023146.6, with English translation.

* cited by examiner

CLEANER COMPOSITION

FIELD

The present invention relates to a cleaner composition and, in particular, to a cleaner composition used for cleaning various kinds of articles such as components handled in various kinds of industrial fields such as automobiles, machinery, precision equipment, electrics, electronics, and optics, piping and apparatuses of various kinds of factories such as oil refinery plants and chemical plants, components obtained by disassembling automobiles, industrial machines, or the like, and metal products, resin products, and textile products used in everyday life.

BACKGROUND

In machining components handled in various kinds of industrial fields such as automobiles, machinery, precision equipment, electrics, electronics, and optics, (i) oil-based machining oils with a mineral oil or the like as a main component, (ii) water-soluble machining oils emulsified in water by adding a surfactant to a mineral oil or the like, (iii) fine particles, or the like are used. Among them, water-soluble machining oils are widely used mainly in cutting, grinding, or the like. For components manufactured through multiple machining processes, different machining oils may be used for the processes, and the machining oils, fine particles, and machining scrap adhere to the surface of the machined components in a mixed manner, whereby various kinds of organic and inorganic contaminants often adhere thereto in a complex manner. Various kinds of organic and inorganic contaminants such as grease, plastic, machine oil, coal tar, clay, sand, and lipid also adhere to piping and apparatuses of various kinds of factories such as oil refinery plants and chemical plants, components obtained by disassembling automobiles, industrial machines, or the like, and metal products, resin products, and textile products used in everyday life, or the like in a complex manner.

When cleaning articles to which such various kinds of organic and inorganic contaminants adhere in a complex manner, cleaners used include chlorine-based solvents such as trichloroethylene and methylene chloride, aqueous cleaners, semi-aqueous cleaners obtained by compounding water-soluble solvents with aqueous cleaners, hydrocarbon-based detergents, alcohol-based cleaners such as isopropanol (2-propanol), and glycol ether-based cleaners. However, none of them can satisfy all requirements such as cleaning ability, dryness, safety, economy, and toxicity for components to which various kinds of organic and inorganic contaminants adhere in a complex manner.

To clean articles to which various kinds of organic and inorganic contaminants adhere, a cleaner composition is developed that contains a nonaqueous cleaner such as a hydrocarbon-based cleaner, a surfactant, a polar solvent, and water in predetermined proportions and forms a W/O microemulsion or a solubilized W/O emulsion (refer to Patent Literature 1, for example). However, in the cleaner composition of Patent Literature 1, the polar solvent is used for the formation of the microemulsion, and the cleaner composition cannot be used for cleaning plastic or rubber materials that have low tolerance against polar solvents, and the plastic or rubber materials that have low tolerance against polar solvents cannot be used as cleaning tools. In addition, there is another problem in that the polar solvent is accumulated in a nonaqueous detergent used in a replacement process as a post-process of a cleaning process, and it is difficult to sustain constant cleaning ability.

A neutral aqueous liquid cleaner composition for liquid crystal panel terminal use is disclosed that contains an alkyl ether of a fatty acid alkylene oxide adduct, a glycol ether-based compound, a $C_{8-18}$ aliphatic hydrocarbon, and a dialkyl sulfosuccinate (refer to Patent Literature 2, for example). However, the cleaner composition of Patent Literature 2 also contains the glycol ether-based compound as a polar solvent for the sake of liquid stability, and the cleaner composition cannot be used for cleaning the plastic or rubber materials that have low tolerance against polar solvents, and the plastic or rubber materials that have low tolerance against polar solvents cannot be used as cleaning tools. In addition, water is used in a replacement process as a post-process of a cleaning process, and the cleaner composition is hard to dry and is inferior in economy.

Furthermore, a method of cleaning is developed that uses a microemulsion type cleaner composition containing an organic solvent selected from aliphatic hydrocarbons, alkylene glycol monoethers, and dialkylene glycol monoethers, water, and a surfactant (refer to Patent Literature 3, for example). However, the cleaner composition of Patent Literature 3 contains a large amount of water, which is 30 parts by weight to 70 parts by weight, especially 35 parts by weight to 60 parts by weight, and detergency against organic contaminants is insufficient, and in addition, a process to remove water adhering to the surface is required before a replacement process with an organic solvent or the like after cleaning with the cleaner composition, thus requiring time for the cleaning process.

Furthermore, a W/O emulsion type hydrocarbon-based cleaner is developed that contains a monocarboxylic acid, a monoalkyl amine, a hydrocarbon, a nonionic surfactant, and water (refer to Patent Literature 4, for example). To reuse a cleaner liquid, the clearing liquid after cleaning treatment is required to be subjected to phase separation to extract a water phase, which is inefficient.

Meanwhile, a hydrocarbon-based cleaner containing a saturated hydrocarbon compound and glycol ethers and a method of cleaning thereof are developed (refer to Patent Literature 5, for example). It is described that the hydrocarbon-based cleaner of Patent Literature 5 has a volume resistivity of $1\times10^{8}$ Ω·cm or more and $1\times10^{13}$ Ω·cm or less and is resistant to electrification, and even when a chargeable object to be cleaned is cleaned, no electrification occurs on the object to be cleaned, and it can be used safely. However, the volume resistivity is not exactly sufficiently low, and electrification may occur, and in addition, a polar solvent such as glycol ether is used, and the hydrocarbon-based cleaner cannot be used for cleaning the plastic or rubber materials that have low tolerance against polar solvents, and the plastic or rubber materials that have low tolerance against polar solvents cannot be used as cleaning tools.

CITATION LIST

Patent Literature

Patent Literature 1: Japanese Laid-open Patent Publication No. 09-157698

Patent Literature 2: Japanese Laid-open Patent Publication No. 2006-225489

Patent Literature 3: Publication of Japanese Translation of PCT Application No. 2004-525753

Patent Literature 4: Japanese Laid-open Patent publication No. 2010-174106

Patent Literature 5: Japanese Laid-open Patent Publication No. 2008-049235

SUMMARY

Technical Problem

The present invention has been made in view of the above circumstances, and an object thereof is to provide a cleaner composition that can clean a wide range of organic and inorganic contaminants safely while preventing electrification.

Solution to Problem

To solve the above-described problem and achieve the object, a cleaner composition includes: a saturated aliphatic hydrocarbon (A); an anionic surfactant (B); a nonionic surfactant (C); and water (D). The cleaner composition contains the saturated aliphatic hydrocarbon (A) in a proportion of 60.0% by mass to 85.0% by mass, the anionic surfactant (B) in a proportion of 8.0% by mass to 15.0% by mass, the nonionic surfactant (C) in a proportion of 2.0% by mass to 5.0% by mass, and the water (D) in a proportion of 1.0% by mass to 20.0% by mass, forms a W/O microemulsion or a solubilized W/O emulsion, and has a volume resistivity of $1\times10^9$ Ω·cm or less.

In the above-described cleaner composition according to the present invention, the saturated aliphatic hydrocarbon (A) is a $C_{9-13}$ paraffinic hydrocarbon.

In the above-described cleaner composition according to the present invention, the anionic surfactant (B) and the nonionic surfactant (C) are contained in a proportion of 10.0% by mass to 20.0% by mass in total, and the anionic surfactant (B) and the nonionic surfactant (C) are compounded in a ratio (mass ratio) of 2.0 to 5.0:1.

The above-described cleaner composition according to the present invention has a saturated water content, measured through turbidity, of 10% by mass or more.

In the above-described cleaner composition according to the present invention, the anionic surfactant (B) is a dialkyl sulfosuccinate, and the nonionic surfactant (C) is a sorbitan fatty acid ester.

The above-described cleaner composition according to the present invention contains no polar solvent.

Advantageous Effects of Invention

The cleaner composition according to the present invention contains the saturated aliphatic hydrocarbon (A), the anionic surfactant (B), the nonionic surfactant (C), and the water (D) in the predetermined proportions, forms the W/O microemulsion or solubilized W/O emulsion, and has a volume resistivity of $1\times10^9$ Ω·cm or less, and a wide range of organic and inorganic contaminants can be cleaned safely.

DESCRIPTION OF EMBODIMENTS

Figure 1:
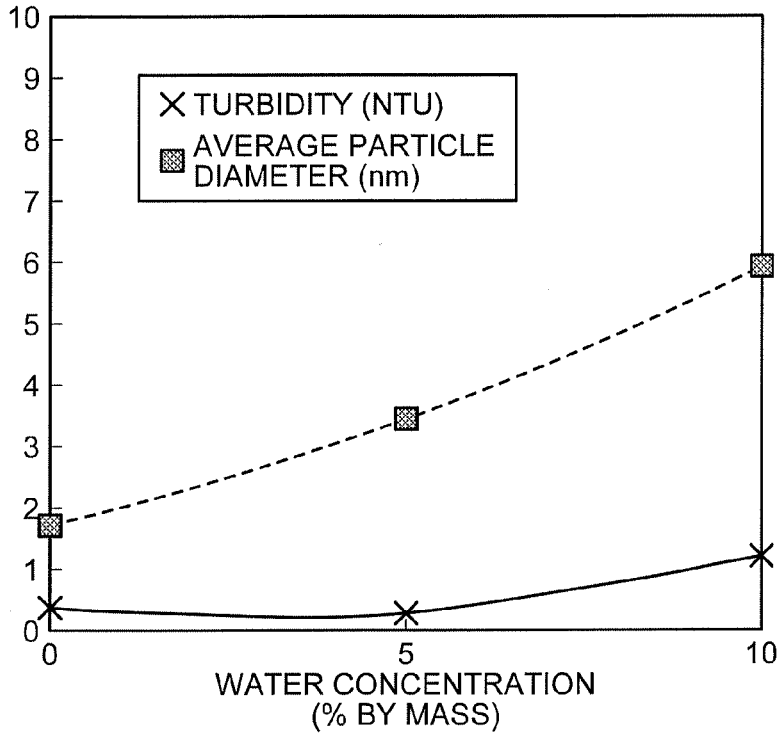
FIG. 1 is a diagram illustrating relations between water concentration and turbidity and an average diameter of a micelle in a cleaner composition according to the present invention.

The following describes a cleaner composition according to the present invention in detail.

The cleaner composition according to the present invention contains a saturated aliphatic hydrocarbon (A), an anionic surfactant (B), a nonionic surfactant (C), and water (D) in predetermined proportions and forms a W/O microemulsion or a solubilized W/O emulsion.

The saturated aliphatic hydrocarbon (A) used in the present invention preferably has a carbon number of 9 to 13. If the carbon number of the saturated aliphatic hydrocarbon (A) is less than 9, the flash point of the cleaner composition lowers, and ignition is more likely to occur. If the carbon number exceeds 14, the viscosity of the cleaner composition increases, and cleaning efficiency may be lowered. The saturated aliphatic hydrocarbon (A) more preferably has a carbon number of 10 to 13 and particularly preferably has a carbon number of 10 to 12.

The saturated aliphatic hydrocarbon (A) is preferably a paraffinic hydrocarbon. When the saturated aliphatic hydrocarbon (A) is a paraffinic hydrocarbon, a stable W/O microemulsion or solubilized W/O emulsion can be formed, which is preferable.

Examples of the saturated aliphatic hydrocarbon (A) according to the present invention include normal paraffinic hydrocarbons such as n-heptane, n-octane, n-nonane, n-decane, n-undecane, n-dodecane, n-tridecane, n-tetradecane, and n-pentadecane; and iso-paraffinic hydrocarbons such as isoheptane, isooctane, isononane, isodecane, isoundecane, isododecane, isotridecane, isotetradecane, and isepentadecane. These may be used singly, or two or more of them may be used. Among these, preferable are n-decane, n-undecane, n-dodecane, isodecane, isoundecane, and isododecane in that they can achieve both stability and cleaning efficiency.

In the cleaner composition according to the present invention, the compounding amount of the saturated aliphatic hydrocarbon (A) is 60.0% by mass to 85.0% by mass. If the compounding amount of the saturated aliphatic hydrocarbon (A) is less than 60.0% by mass, cleaning ability against organic contaminants may be lowered. If the compounding amount of the saturated aliphatic hydrocarbon (A) exceeds 85.0% by mass, cleaning ability against inorganic contaminants may be lowered. The compounding amount of the saturated aliphatic hydrocarbon (A) is preferably 75.0% by mass to 80.0% by mass.

The anionic surfactant (B) used in the present invention can appropriately be selected in accordance with an object, and examples thereof include sulfonates, sulfates, and carboxylates such as petroleum sulfonates and turkey-red oil.

Among them, preferable examples of sulfonates include sulfonates of $C_{8-22}$ hydrocarbons. Preferable examples of sulfates include $C_{8-18}$ sulfonated oils and $C_{8-18}$ alkyl sulfates. Preferable examples of carboxylates include dialkyl sulfosuccinates having a $C_{6-13}$ alkyl group, $C_{6-13}$ alkyl disulfosuccinates, and polyoxyethylene alkyl disulfosuccinates having a $C_{6-13}$ alkyl group. The anionic surfactant (B) is suitable for forming a stable W/O microemulsion or solubilized W/O emulsion. The dialkyl sulfosuccinates having a $C_{6-13}$ alkyl group such as sodium di(2-ethylhexyl)sulfosuccinate are particularly preferable for forming a more stable W/O microemulsion or solubilized W/O emulsion.

As to the sulfonates used as the anionic surfactant (B), any substance other than alkyl benzene sulfonates is preferable in view of reducing influence on the environment and easiness of control.

As to a salt of a surfactant used as the anionic surfactant (B), alkali metal salts, alkaline earth metal salts, ammonium salts, and alkanolamine salts can be exemplified, and acid forms such as sulfonic acid, sulfates, and carboxylic acid can also be used. The surfactant exemplified above may be used singly, or two or more of them may be used.

In the cleaner composition according to the present invention, the compounding amount of the anionic surfactant (B) is 8.0% by mass to 15.0% by mass. If the compounding amount of the anionic surfactant (B) is less than 8.0% by mass, cleaning ability against inorganic contaminants may be lowered. If the compounding amount of the anionic surfactant (B) exceeds 15.0% by mass, cleaning ability against organic contaminants may be lowered. The compounding amount of the anionic surfactant (B) is preferably 9.0% by mass to 15.0% by mass.

The nonionic surfactant (C) used in the present invention can appropriately be selected in accordance with an object, and examples thereof include polyalkylene glycols and fatty acid esters. The fatty acid esters are particularly preferable, because they can form a stable W/O microemulsion or solubilized W/O emulsion.

Examples of the polyalkylene glycols used as the nonionic surfactant (C) include polyoxyethylene-polyoxypropylene block copolymers and polyoxyethylene polyoxypropylene alkyl ethers. When polyalkylene glycols are used as the nonionic surfactant (C), thermal stability can be improved.

The polyoxyethylene-polyoxypropylene block copolymer is a compound represented by the following Formula (1) or Formula (2):

$$HO—(C_2H_4O)_a—(C_3H_6O)_b—(C_2H_4O)_c—H \quad (1)$$

$$HO—(C_3H_6O)_a—(C_2H_4O)_b—(C_3H_6O)_c—H \quad (2)$$

In Formula (1) and Formula (2), a is preferably 2 to 160, b is preferably 10 to 60, and c is preferably 2 to 160.

The polyoxyethylene-polyoxypropylene block copolymer used as the nonionic surfactant (C) preferably has a molecular weight of the polyoxypropylene moiety of 3,500 or less and contains 50% by mass or less of the polyethylene oxide moiety.

The polyoxyethylene polyoxypropylene alkyl ether is a compound represented by the following Formula (3):

$$R^1—O—(C_3H_6O)_m—(C_2H_4O)_n—H \quad (3)$$

In Formula (3), $R^1$ is a $C_{6-16}$ alkyl group, and n and m are preferably 2 to 16.

As to the polyalkylene glycols used as the nonionic surfactant (C), any substance other than polyoxyethylene alkyl ethers and polyoxyethylene alkylphenyl ethers is preferable in view of reducing influence on the environment and easiness of control.

Examples of the fatty acid esters used as the nonionic surfactant (C) include sorbitan fatty acid esters, ethylene glycol fatty acid esters, glycerin fatty acid esters, propylene glycol fatty acid esters, and polyoxy fatty acid esters. The fatty acid esters are preferable, because they can improve cleaning ability. Among them, sorbitan fatty acid esters are preferable, because they can form a more stable W/O microemulsion or solubilized W/O emulsion.

In the cleaner composition according to the present invention, the compounding amount the nonionic surfactant (C) is 2.0% by mass to 5.0% by mass. If the compounding amount of the nonionic surfactant (C) is less than 2.0% by mass, cleaning ability against inorganic contaminants may be lowered. If the compounding amount of the nonionic surfactant (C) exceeds 5.0% by mass, cleaning ability against organic contaminants may be lowered. The compounding amount of the nonionic surfactant (C) is preferably 3.0% by mass to 5.0% by mass.

As to the water (D) used in the present invention, distilled water, ion-exchanged water, or the like can be used.

In the cleaner composition according to the present invention, the compounding amount of the water (D) is 1.0% by mass to 20.0% by mass. If the compounding amount of the water (D) is less than 1.0% by mass, cleaning ability against inorganic contaminants may be lowered. If the compounding amount of the water (D) exceeds 20.0% by mass, cleaning ability against organic contaminants may be lowered. The compounding amount of the water (D) is preferably 5.0% by mass to 15.0% by mass and particularly preferably 5.0% by mass to 10.0% by mass.

Although the cleaner composition according to the present invention is brought into contact with an object to be cleaned as it is to clean the object to be cleaned, the water (D), which is within the range of the above-described compounding amount of the water (D), can further be added to a cleaner composition with a less compounding amount of the water (D) or a cleaner composition with a predetermined compounding amount thereof before cleaning to perform cleaning. The cleaner composition according to the present invention can achieve high cleaning ability while reducing quality fluctuations during storage and transportation, storage space, and transportation costs by additionally compounding the water (D) during use.

The cleaner composition according to the present invention forms the W/O microemulsion or solubilized W/O emulsion. By forming the W/O microemulsion or solubilized W/O emulsion, cleaning irregularities can be prevented. The cleaner composition according to the present invention forms the stable W/O microemulsion or solubilized W/O emulsion even at a low temperature and can exhibit high cleaning ability without heating and can clean materials vulnerable to heat.

In order to form a stable W/O microemulsion or solubilized W/O emulsion, polar solvents such as glycol ethers, alcohols, glycols, and polyoxy alkylene alkyl ethers have conventionally been used in addition to water, nonaqueous cleaners forming an oil layer, and surfactants. However, cleaner compositions containing polar solvents erode specific resin and rubber materials such as an ABS resin, an acrylic resin, vinyl chloride, a nitrile rubber, an urethane rubber, and a fluorocarbon rubber and are difficult to be used for cleaning objects to be cleaned for which these materials are used. In addition, special attention is required for the material of cleaning tools made of resin.

The inventors of the present invention, after earnest study, have found that the cleaner composition containing the saturated aliphatic hydrocarbon (A), the anionic surfactant (B), the nonionic surfactant (C), and the water (D) in the predetermined compounding amounts can form a stable W/O microemulsion or solubilized W/O emulsion without using any polar solvent. The cleaner composition according to the present invention forms the stable W/O microemulsion or solubilized W/O emulsion, thereby providing such an excellent effect that high cleaning effect can be exhibited without using any polar solvent even for inorganic contaminants against which cleaning effect is low only by a nonaqueous detergent such as the saturated aliphatic hydrocarbon (A).

In the present specification, the W/O microemulsion refers to a state in which the water (D) and the surfactants form a micelle having an average particle diameter of about 10 nm to 100 nm and is dispersed in an oil layer, that is, the saturated aliphatic hydrocarbon (A) in the present invention and is in semitransparent or transparent liquid form. The solubilized W/O emulsion refers to a state in which the water (D) and the surfactants form a micelle having an average particle diameter of about 1 to 10 nm and is dispersed in an oil layer, that is, the saturated aliphatic hydrocarbon (A) in the present invention and is in transparent liquid form. The W/O microemulsion or solubilized W/O emulsion has a small particle diameter of the water (D) dispersed and does not undergo phase separation even when it is left standing for a long term. The average particle diameter of the micelle is measured by a measuring apparatus of zeta-potential, particle diameter, and molecular weight. Although Zetasizer Nano (manufactured by Spectris Co., Ltd.) was used in the present specification, that is not limiting.

Although the formation of the W/O microemulsion or solubilized W/O emulsion can be determined by measuring the average particle diameter of the micelle, there is correlation between the average particle diameter of the micelle and the turbidity (JIS K0101) of the cleaner composition, and the presence or absence of the formation of the W/O microemulsion or solubilized W/O emulsion was determined through the measurement of the turbidity of the cleaner composition in the present specification. It was determined that the W/O microemulsion or solubilized W/O emulsion was formed if the turbidity of the cleaner composition according to the present invention was 100 NTU or less. As to the cleaner composition according to the present invention, a containable upper limit value (a saturated water content, % by mass) of the water (D) was also similarly determined through the turbidity.

The cleaner composition according to the present invention has a volume resistivity of $1\times10^9$ Ω·cm or less, preferably $2\times10^8$ Ω·cm or less, and particularly preferably less than $1\times10^8$ Ω·cm. The volume resistivity was measured using an insulation resistance measuring device in conformity with JIS C 2320 1 minute after applying a DC voltage of 250 V to a sample at 25° C. through an insulation resistance value. If the volume resistivity is $1\times10^9$ Ω·cm or less, materials such as plastics that are likely to be electrified can also be cleaned safely. The cleaner composition according to the present invention has low volume resistivity and can perform not only immersion cleaning but also spray cleaning safely. In addition, polishing and cleaning of an object to be cleaned can be simultaneously performed, electrification of the object to be cleaned and cleaned contaminants can be prevented, and re-adhesion of the contaminants to the object to be cleaned can also be prevented.

The cleaner composition according to the present invention preferably contains the anionic surfactant (B) and the nonionic surfactant (C) in a proportion of 10.0% by mass to 20.0% by mass in total and compounds the anionic surfactant (B) and the nonionic surfactant (C) in a ratio (mass ratio) of 2.0 to 5.0:1.

In the cleaner composition according to the present invention, if the total compounding amount of the anionic surfactant (B) and the nonionic surfactant (C) is less than 10.0% by mass, cleaning efficiency against inorganic contaminants may be lowered. If the total compounding amount exceeds 20.0% by mass, cleaning efficiency against organic contaminants may be lowered. The total compounding amount of the anionic surfactant (B) and the nonionic surfactant (C) is preferably 12.0% by mass to 20.0% by mass.

In the cleaner composition according to the present invention, as to the compounding ratio (mass ratio) between the anionic surfactant (B) and the nonionic surfactant (C), the anionic surfactant (B) is preferably 2.0 to 5.0 folds with the nonionic surfactant (C) set to be 1. If the compounding ratio of the anionic surfactant (B) is less than 2.0 folds or exceeds 5.0 folds of the nonionic surfactant, cleaning efficiency against inorganic contaminants may be lowered.

The saturated water content of the cleaner composition according to the present invention is preferably 10% by mass or more. If the saturated water content is 10% by mass or more, the water (D) is dispersed in the saturated aliphatic hydrocarbon (A) in a large proportion, and cleaning ability against inorganic contaminants can be improved while maintaining cleaning ability against organic contaminants. The saturated water content of the cleaner composition according to the present invention is preferably 10% by mass or more and more preferably 10% by mass to 35% by mass.

The saturated water content of the cleaner composition refers to the proportion (% by mass) of the water (D) to the cleaner composition when the water (D) is compounded to a composition containing the saturated aliphatic hydrocarbon (A), the anionic surfactant (B), and the nonionic surfactant (C) and the turbidity (JIS K0101) of the cleaner composition after adding the water (D) becomes 100 NTU. Although a portable turbidity meter Type 2100P (manufactured by Central Kagaku Corp.) was used for the measurement of the turbidity of the cleaner composition, that is not limiting.

The cleaner composition according to the present invention may contain, in addition to the saturated aliphatic hydrocarbon (A), the anionic surfactant (B), the nonionic surfactant (C), and the water (D), other cleaner components or various kinds of additives to the extent that the effect of the present invention is not impaired.

Examples of the other cleaner components include hydrocarbons other than the saturated aliphatic hydrocarbon (A) including, for example, alkyl benzenes such as trimethyl benzene, ethyl toluene, and tetramethyl benzene and alkyl naphthalenes such as methyl naphthalene, ethyl naphthalene, and dimethyl naphthalene.

Examples of the additives include anticorrosives, antioxidants, antiseptics, chelating agents, alkali agents, bleaching agents, and odorants. Examples of the anticorrosives include fatty acid ester-based anticorrosives such as pentaerythritol monoesters and sorbitan monooleate; amine-based anticorrosives such as amines and amine salts; carboxylic acid-based anticorrosives such as aromatic carboxylic acids, alkenyl succinic acids, and naphthenates; organic sulfonic acid-based anticorrosives such as petroleum sulfonates; organic phosphoric acid-based anticorrosives; and oxidized paraffin-based anticorrosives.

Although the compounding amounts of the other components to the cleaner composition are not limited to the extent that the effect of the present invention is not impaired, they are preferably 10.0% by mass or less, more preferably 5.0% by mass or less, and further preferably 1.0% by mass or less in the cleaner composition. If the compounding amounts of the other components exceed 10.0% by mass, cleaning efficiency against inorganic contaminants may be lowered, and in addition, the formation of a stable W/O microemulsion or solubilized W/O emulsion may be inhibited.

The cleaner composition according to the present invention can be manufactured by weighing, mixing, and stirring predetermined amounts of the above-described components. There is no limitation on an order of compounding and a method of stirring. The components in the predetermined proportions are mixed and stirred, thereby manufacturing the cleaner composition forming the stable W/O microemulsion or solubilized W/O emulsion.

A method of cleaning using the cleaner composition according to the present invention can be performed by immersion of an object to be cleaned into the cleaner composition according to the present invention, spraying the object to be cleaned with the cleaner composition according to the present invention, wiping the surface of the object to be cleaned with a sponge or the like impregnated with the cleaner composition, or the like. In the case of cleaning by the immersion into the cleaner composition, cleaning effect can be improved by performing ultrasonication, stirring, air bubbling, or shaking of the object to be cleaned. Cleaning effect can also be improved by heating the cleaner composition so as to perform cleaning.

After cleaning the object to be cleaned with the cleaner composition according to the present invention, for the purpose of removing the cleaner composition remaining on the surface of the object to be cleaned and the surfactants compounded in the cleaner composition, rinsing is preferably performed with the saturated aliphatic hydrocarbon (A) used as the cleaner composition according to the present invention or any hydrocarbon such as n-decane having a lower boiling point than that of the saturated aliphatic hydrocarbon (A). The rinsing may be performed once or twice or more.

EXAMPLES

The following describes the present invention specifically with reference to examples and comparative examples. The present invention is not limited to the following examples.

Experimental Example 1

Figure 2:
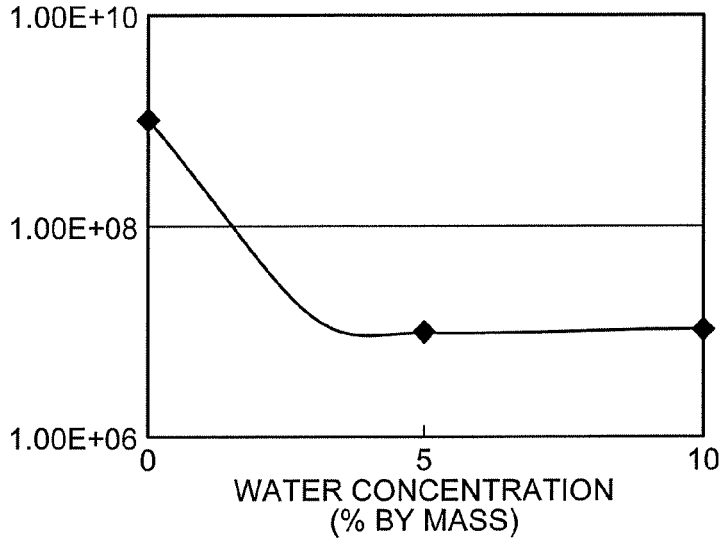
FIG. 2 is a diagram illustrating a relation between water concentration and volume resistivity in the cleaner composition according to the present invention.

In a container, 31.1 parts by mass of n-undecane and 31.0 parts by a mass of n-dodecane as the saturated aliphatic hydrocarbons (A), 8.9 parts by mass of sodium di(2-ethylhexyl)sulfosuccinate as the anionic surfactant (B), and 3.0 parts by mass of sorbitan trioleate as the nonionic surfactant (C) were weighed and mixed, and the water (D) was added to the mixture to measure relations of an average particle diameter of a micelle and turbidity at different added amounts (% by mass of the water in the detergent composition) of the water. The result is illustrated in FIG. 1. A relation between the added amount of the water and volume resistivity was measured. The result is illustrated in FIG. 2. The saturated water amount (% by mass of the water in the cleaner composition when the turbidity became 100 NTU) of the detergent composition was 26% by mass.

Cleaning Test on Water-Soluble Machining Oil

The following water-soluble machining oils (I) and (II) were diluted two times with distilled water. A degreased SUS component (a claw-equipped corrugated cage: an object to be cleaned) with known mass was immersed into diluted water-soluble machining oils (I) and (II) and was air-dried using a hot air drier (product name: SPHH-201 (manufactured by ESPEC)) at 40° C. for 3 hours. The object to be cleaned was immersed into each cleaner composition of Examples 1 to 10 and Comparative Examples 1 to 6 listed in Table 1 and Table 2, was cleaned using an ultrasonic cleaner (product name: W-113 (manufactured by Honda Electronics Co., Ltd.)) at 28 kHz at 25° C. for 3 minutes, and was rinsed with n-decane at 25° C. for 1 minute while shaking the object to be cleaned. The object to be cleaned was dried using the hot air drier (product name: SPHH-201 (manufactured by ESPEC)) at 80° C. for 20 minutes, and then a residual oil content was measured. The results are listed in Table 1 and Table 2.

Criteria

A: The residual oil content is less than 0.001 g.

B: The residual oil content is 0.001 g or more.

Water-Soluble Machining Oils Used (I) Castrol Hysol X (Classification: Type A1, No. 2; manufactured by BP Japan K. K.)

(II) Castrol Alusol B (Classification: Type A2, No. 2; manufactured by BP Japan K. K.)

Cleaning Test on Simulated Particles

A 10% by mass aqueous solution of a water-soluble machining oil Castrol Syntilo 81 (Classification: Type A3, No. 2; manufactured by BP Japan K. K.) was prepared (water-soluble machining oil (III)). A drop of the prepared 10% by mass aqueous solution of water-soluble machining oil (III) was applied to a degreased iron sheet (SPCC-SB, JIS G3141, 30 mm×30 mm×1 mm was polished with #240, referred to as an object to be cleaned). Onto the iron sheet to which the machining oil has been applied, 0.02 g of iron powder (electrolytic iron manufactured by Kanto Chemical Co., Inc.) was sprayed, was spread up to about 5 mm off the edge of the iron sheet, and was dried using the hot air drier (product name: SPHH-201 (manufactured by ESPEC)) at 120° C. for 3 hours. The object to be cleaned was immersed into each of the cleaner compositions of Example 1 to 10 and Comparative Examples 1 to 6 listed in Table 1 and Table 2 and was cleaned using the ultrasonic cleaner (product name: W-113 (manufactured by Honda Electronics Co., Ltd.)) at 45 kHz at 25° C. for 3 minutes. The object to be cleaned was pulled out of each cleaner composition and was drained, and the iron powder remaining on the surface was visually observed. The results are listed in Table 1 and Table 2. A to C in the following criteria were determined to be passed.

Criteria

A: No iron powder is observed.

B: A few pieces of iron powder remain.

C: A few tens of pieces of iron powder remain.

D: A few hundreds of pieces of iron powder remain.

Cleaning Test on Oil-Based Machining Oil

A degreased iron sheet (SPCC-SB, JIS G3141, 30 mm×30 mm×1 mm was polished with #240, referred to as an object to be cleaned) with known mass was immersed into an industrial general-purpose oil Lathus 150 (manufactured by JX Nippon Oil & Energy Corporation), was dried using the hot air drier (product name: SPHH-201 (manufactured by ESPEC)) at 120° C. for 3 hours, and was left to be cooled, and an adhering oil content was measured. The object to be cleaned was immersed into each of the cleaner compositions of Example 1 to 10 and Comparative Examples 1 to 6 listed in Table 1 and Table 2 to be cleaned for 2 minutes and was rinsed by immersing it into n-decane at 25° C. for 10 seconds. The object to be cleaned was dried using the hot air drier (product name: SPHH-201 (manufactured by ESPEC)) at 70° C. for 40 minutes, and then a residual oil content was measured. The results are listed in Table 1 and Table 2.

Criteria

A: The removing rate is 99% by mass or more.

B: The removing rate is less than 99% by mass.

Flux Cleaning Test

The following thread solders (I) and (II) were soldered to a substrate (ICB-96PU, referred to as an object to be cleaned) with a soldering iron. The object to be cleaned was immersed into each of the cleaner compositions of Examples 1 to 10 and Comparative Examples 1 to 6 listed in Table 1 and Table 2 and was cleaned using the ultrasonic cleaner (product name: W-113 (manufactured by Honda Electronics Co., Ltd.)) at 28 kHz at 25° C. for 2 minutes. The cleaned substrate was visually observed with a stereo microscope Stemi DV4 (manufactured by Carl Zeiss). The results are listed in Table 1 and Table 2. A and B in the following criteria were determined to be passed.

Criteria

A: There is no residue.

B: There is a little residue.

C: There is a partial residue.

D: There is a white residue.

Thread Solders Used (I) Sparkle Solder 70 (manufactured by Senju Metal Industry Co., Ltd.)

(II) Sparkle ESC21 (manufactured by Senju Metal Industry Co., Ltd.)

Formation of W/O Microemulsion or Solubilized Type W/O Emulsion

The turbidity of the cleaner compositions of the examples and the comparative examples listed in Table 1 to Table 11 was measured using the portable turbidity meter Type 2100P (manufactured by Central Kagaku Corp). A cleaner composition the turbidity of which was 100 NTU or less was determined to have formed a W/O microemulsion or a solubilized W/O emulsion.

Criteria

A: The turbidity is 100 NTU or less.

B: The turbidity exceeds 100 NTU.

Measurement of Saturated Water Content

The saturated aliphatic hydrocarbon (A), the anionic surfactant (B), the nonionic surfactant (C), and the other components, if any, were mixed in the proportions listed in Table 1 to Table 8, and turbidity when the water (D) was added to the mixture was measured using the portable turbidity meter Type 2100P (manufactured by Central Kagaku Corp). The water (D) was added until the turbidity became 100 NTU, and the added amount (the proportion to the detergent composition, % by mass) of the water when the turbidity was 100 NTU was determined, thereby calculating the saturated water content.

Wax Cleaning Test

The following waxes (I) and (II) were applied to a copper sheet (C1100P, JIS H3100, 75 mm×12.5 mm×3.0 mm, referred to as an object to be cleaned). The object to be cleaned was immersed into each of the cleaner compositions of the Examples and the Comparative Examples listed in Table 1 to Table 8 and Table 11, was cleaned using the ultrasonic cleaner (product name: W-113 (manufactured by Honda Electronics Co., Ltd.)) at 28 kHz at 25° C. for 2 minutes, and was rinsed by immersing it into n-decane at 25° C. for 30 seconds. The cleaned surface of the copper sheet was visually observed. The results are listed in Table 1 to Table 8 and Table 11.

Criteria

A: There is no residue.

B: There is a residue.

Waxes Used (I) Paraffin Wax 135 (manufactured by Nippon Seiro Co., Ltd.)

(II) Aquawax 553 (manufactured by Nikka Seiko Co. Ltd.)

TABLE 1

| | | | Comparative Example 1 | Comparative Example 2 | Comparative Example 3 | Example 4 | Example 5 | Example 1 | Example 2 | Example 3 |
|---|---|---|---|---|---|---|---|---|---|---|
| Compounding amount (% by mass) | (A) | n-Decane | 83.1 | 81.5 | 79.8 | 75.6 | 67.2 | 100.0 | 83.7 | 58.8 |
| | (B) | Sodium di(2-ethylhexyl) sulfosuccinate | 11.9 | 11.6 | 11.4 | 10.8 | 9.6 | 0.0 | 12.0 | 8.4 |
| | (C) | Sorbitan trioleate | 4.0 | 3.9 | 3.8 | 3.6 | 3.2 | 0.0 | 4.0 | 2.8 |
| | (D) | Water | 1.0 | 3.0 | 5.0 | 10.0 | 20.0 | 0.0 | 0.3 | 30.0 |
| Compounding ratio | | (B)/(C) | 3.0 | 3.0 | 3.0 | 3.0 | 3.0 | — | 3.0 | 3.0 |
| Total compounding amount | | (B) + (C) | 15.9 | 15.5 | 15.2 | 14.4 | 12.8 | — | 16.0 | 3.0 |
| Turbidity | | | A | A | A | A | A | — | A | B |
| Saturated water content (% by mass) | | | 25 | 25 | 25 | 25 | 25 | <1 | 25 | 25 |
| Cleaning ability | | Castrol Hysol X | A | A | A | A | A | B | A | B |
| | | Castrol Alusol B | A | A | A | A | A | B | B | B |
| | | Castrol Syntilo 81 | C | B | B | B | B | D | D | C |
| | | Lathus 150 | A | A | A | A | A | A | A | B |
| | | Sparkle Solder 70 | A | A | A | A | A | A | A | C |
| | | Sparkle ESC21 | A | A | A | A | A | C | A | C |
| | | Paraffin Wax 135 | — | — | A | A | — | A | — | — |
| | | Aquawax 553 | — | — | A | A | — | B | — | — |
| Volume resistivity (Ω · cm) | | | $2 \times 10^8$ | $4 \times 10^7$ | $3 \times 10^7$ | $4 \times 10^7$ | $8 \times 10^7$ | $4 \times 10^{16}$ | $4 \times 10^8$ | — |

TABLE 2

| | | | Example 6 | Example 7 | Example 8 | Example 9 | Example 10 | Comparative Example 4 | Comparative Example 5 | Comparative Example 6 |
|---|---|---|---|---|---|---|---|---|---|---|
| Compounding amount (% by mass) | (A) | n-Decane | 83.1 | 81.5 | 79.8 | 75.6 | 67.2 | 100.0 | 83.7 | 58.8 |
| | (B) | Sodium di(2-ethylhexyl) sulfosuccinate | 11.9 | 11.6 | 11.4 | 10.8 | 9.6 | 0.0 | 12.0 | 8.4 |

TABLE 2-continued

| | | | Example 6 | Example 7 | Example 8 | Example 9 | Example 10 | Comparative Example 4 | Comparative Example 5 | Comparative Example 6 |
|---|---|---|---|---|---|---|---|---|---|---|
| | (C) | Sorbitan trioleate | 4.0 | 3.9 | 3.8 | 3.6 | 3.2 | 0.0 | 4.0 | 2.8 |
| | (D) | Water | 1.0 | 3.0 | 5.0 | 10.0 | 20.0 | 0.0 | 0.3 | 30.0 |
| Compounding ratio | | (B)/(C) | 3.0 | 3.0 | 3.0 | 3.0 | 3.0 | — | 3.0 | 3.0 |
| Total compounding amount | | (B) + (C) | 15.9 | 15.5 | 15.2 | 14.4 | 12.8 | — | 16.0 | 3.0 |
| Turbidity | | | A | A | A | A | A | — | A | B |
| Saturated water content (% by mass) | | | 26 | 26 | 26 | 26 | 26 | <1 | 26 | 26 |
| Cleaning ability | | Castrol Hysol X | A | A | A | A | A | B | A | B |
| | | Castrol Alusol B | A | A | A | A | A | B | B | B |
| | | Castrol Syntilo 81 | C | B | B | B | B | D | B | C |
| | | Lathus 150 | A | A | A | A | A | A | A | B |
| | | Sparkle Solder 70 | A | A | A | A | A | A | A | C |
| | | Sparkle ESC21 | A | A | A | A | A | C | A | C |
| | | Paraffin Wax 135 | — | — | A | A | — | A | — | — |
| | | Aquawax 553 | — | — | A | A | — | B | — | — |

TABLE 3

| | | | Example 11 | Example 12 | Example 13 | Example 14 | Example 15 | Example 16 | Comparative Example 7 | Comparative Example 8 |
|---|---|---|---|---|---|---|---|---|---|---|
| Compounding amount (% by mass) | (A) | n-Decane | 60.0 | 70.0 | 60.0 | 60.0 | 79.8 | 79.8 | 79.8 | 79.8 |
| | (B) | Sodium di(2-ethylhexyl) sulfosuccinate | 15.0 | 15.0 | 15.0 | 15.0 | 8.0 | 9.0 | — | 15.2 |
| | (C) | Sorbitan trioleate | 5.0 | 5.0 | 5.0 | 5.0 | 3.8 | 3.8 | 15.2 | — |
| | (D) | Water | 20.0 | 10.0 | 15.0 | 10.0 | 8.4 | 7.4 | 5.0 | 5.0 |
| | Other | Alkyl benzene | — | — | 5.0 | 10.0 | — | — | — | — |
| Compounding ratio | | (B)/(C) | 3.0 | 3.0 | 3.0 | 3.0 | 2.1 | 2.4 | — | — |
| Total compounding amount | | (B) + (C) | 20.0 | 20.0 | 20.0 | 20.0 | 11.8 | 12.8 | 15.2 | 15.2 |
| Turbidity | | | A | A | A | A | A | A | B | A |
| Saturated water content (% by mass) | | | 35 | 35 | 32 | 30 | 10 | 13 | 1 | 17 |
| Cleaning ability | | Paraffin Wax 135 | A | A | A | A | A | A | B | B |
| | | Aquawax 553 | A | A | A | A | A | A | B | A |

TABLE 4

| | | | Comparative Example 9 | Comparative Example 10 | Comparative Example 11 | Comparative Example 12 | Example 17 | Example 18 | Example 19 |
|---|---|---|---|---|---|---|---|---|---|
| Compounding amount (% by mass) | (A) | n-Decane | — | 84.8 | 14.0 | 10.0 | 79.8 | 79.8 | 79.8 |
| | (B) | Sodium di(2-ethylhexyl) sulfosuccinate | 11.4 | 11.4 | 11.4 | 11.4 | 8.0 | 10.0 | 11.4 |
| | (C) | Sorbitan trioleate | 3.8 | 3.8 | 3.8 | 3.8 | 2.0 | 5.0 | 3.8 |
| | (D) | Water | 5.0 | — | 5.0 | 5.0 | 10.2 | 5.2 | 5.0 |
| | Other | Alkyl benzene | 79.8 | — | 65.8 | 69.8 | — | — | — |
| Compounding ratio | | (B)/(C) | 3.0 | 3.0 | 3.0 | 3.0 | 4.0 | 2.0 | 3.0 |
| Total compounding amount | | (B) + (C) | 15.2 | 15.2 | 15.2 | 15.2 | 10.0 | 15.0 | 15.2 |
| Turbidity | | | A | — | A | A | A | A | A |
| Saturated water content (% by mass) | | | 6 | 24 | 9 | 9 | 17 | 10 | 25 |
| Cleaning ability | | Paraffin Wax 135 | B | A | A | A | A | A | A |
| | | Aquawax 553 | B | B | B | B | A | A | A |

TABLE 5

| | | | Comparative Example 13 | Comparative Example 14 | Comparative Example 15 | Comparative Example 16 | Comparative Example 17 | Comparative Example 18 | Comparative Example 19 | Comparative Example 20 |
|---|---|---|---|---|---|---|---|---|---|---|
| Compounding amount (% by mass) | (A) | n-Decane | 79.8 | 79.8 | 79.8 | 79.8 | 79.8 | 79.8 | 79.8 | 79.8 |
| | (B) | Sodium di(2-ethylhexyl) sulfosuccinate | 7.6 | 7.8 | 15.2 | 16.0 | 8.3 | 8.1 | 10.2 | 12.0 |
| | (C) | Sorbitan trioleate | 3.8 | 3.8 | 3.8 | 3.8 | 1.7 | 1.9 | 5.1 | 6.0 |
| | (D) | Water | 8.8 | 8.6 | 1.2 | 0.4 | 10.2 | 10.2 | 4.9 | 2.2 |
| Compounding ratio | | (B)/(C) | 2.0 | 2.1 | 4.0 | 4.2 | 4.9 | 4.3 | 2.0 | 2.0 |
| Total compounding amount | | (B) + (C) | 11.4 | 11.6 | 19.0 | 19.8 | 10.0 | 10.0 | 15.3 | 18.0 |
| Turbidity | | | B | A | A | A | A | A | A | A |
| Saturated water content (% by mass) | | | 8 | 9 | 27 | 27 | 14 | 17 | 11 | 12 |
| Cleaning ability | Paraffin Wax 135 | | A | A | B | B | A | A | A | A |
| | Aquawax 553 | | B | B | A | A | B | B | B | B |

TABLE 6

| | | | Comparative Example 21 | Comparative Example 22 | Example 20 | Example 21 | Example 22 | Example 23 | Example 24 | Example 25 |
|---|---|---|---|---|---|---|---|---|---|---|
| Compounding amount (% by mass) | (A) | n-Decane | 84.7 | 63.8 | 74.8 | 69.8 | 64.8 | 79.8 | 79.8 | 79.8 |
| | (B) | Sodium di(2-ethylhexyl) sulfosuccinate | 11.4 | 11.4 | 11.4 | 11.4 | 11.4 | 10.2 | 12.2 | 12.6 |
| | (C) | Sorbitan trioleate | 3.8 | 3.8 | 3.8 | 3.8 | 3.8 | 5.0 | 3.0 | 2.6 |
| | (D) | Water | 0.1 | 21.0 | 10.0 | 15.0 | 20.0 | 5.0 | 5.0 | 5.0 |
| Compounding ratio | | (B)/(C) | 3.0 | 3.0 | 3.0 | 3.0 | 3.0 | 2.0 | 4.1 | 4.8 |
| Total compounding amount | | (B) + (C) | 15.2 | 15.2 | 15.2 | 15.2 | 15.2 | 15.2 | 15.2 | 15.2 |
| Turbidity | | | A | A | A | A | A | A | A | A |
| Saturated water content (% by mass) | | | 24 | 29 | 24 | 28 | 29 | 11 | 23 | 20 |
| Cleaning ability | Paraffin Wax 135 | | A | B | A | A | A | A | A | A |
| | Aquawax 553 | | B | A | A | A | A | A | A | A |

TABLE 7

| | | | Example 26 | Example 27 | Example 28 | Comparative Example 23 | Comparative Example 24 | Comparative Example 25 | Comparative Example 26 |
|---|---|---|---|---|---|---|---|---|---|
| Compounding amount (% by mass) | (A) | n-Decane | 79.8 | 79.8 | 74.8 | 79.8 | 79.8 | 79.8 | 73.8 |
| | (B) | Sodium di(2-ethylhexyl) sulfosuccinate | 8.0 | 12.0 | 15.0 | 10.0 | 13.2 | 7.5 | 16.0 |
| | (C) | Sorbitan trioleate | 2.0 | 3.0 | 5.0 | 5.2 | 2.0 | 2.0 | 5.0 |
| | (D) | Water | 10.2 | 5.2 | 5.2 | 5.0 | 5.0 | 10.7 | 5.2 |
| Compounding ratio | | (B)/(C) | 4.0 | 4.0 | 3.0 | 1.9 | 6.6 | 3.8 | 3.2 |
| Total compounding amount | | (B) + (C) | 10.0 | 15.0 | 20.0 | 15.2 | 15.2 | 9.5 | 21.0 |
| Turbidity | | | A | A | A | A | A | A | A |
| Saturated water content (% by mass) | | | 17 | 23 | 31 | 10 | 24 | 17 | 31 |
| Cleaning ability | Paraffin Wax 135 | | A | A | A | A | B | A | B |
| | Aquawax 553 | | A | A | A | B | A | B | A |

TABLE 8

| | | | Example 29 | Example 30 | Example 31 | Comparative Example 27 | Comparative Example 28 |
|---|---|---|---|---|---|---|---|
| Compounding amount (% by mass) | (A) | n-Decane | 75.0 | 69.1 | 64.1 | 70.9 | 65.1 |
| | (B) | Sodium di(2-ethylhexyl) sulfosuccinate | 10.0 | 11.2 | 11.6 | 9.4 | 10.5 |
| | (C) | Sorbitan trioleate | 5.0 | 4.7 | 4.3 | 4.7 | 4.4 |
| | (D) | Water | 10.0 | 15.0 | 20.0 | 15.0 | 20.0 |
| Compounding ratio | | (B)/(C) | 2.0 | 2.4 | 2.7 | 2.0 | 2.4 |
| Total compounding amount | | (B) + (C) | 15.0 | 15.9 | 15.9 | 14.1 | 14.9 |
| Turbidity | | | A | A | A | B | B |
| Saturated water content (% by mass) | | | 10 | 15 | 20 | 10 | 15 |
| Cleaning ability | Paraffin Wax 135 | | A | A | A | B | B |
| | Aquawax 553 | | A | A | A | B | B |

TABLE 9

| | | | Example 32 | Example 33 | Example 34 | Example 35 | Example 36 | Example 37 | Example 38 | Example 39 |
|---|---|---|---|---|---|---|---|---|---|---|
| Compounding amount (% by mass) | (A) | n-Decane | 79.8 | 74.8 | 75.0 | 69.1 | 64.1 | — | — | — |
| | | n-Octane | — | — | — | — | — | 79.8 | — | — |
| | | n-Nonane | — | — | — | — | — | — | 79.8 | — |
| | | n-Undecane | — | — | — | — | — | — | — | 79.8 |
| | | n-Tridecane | — | — | — | — | — | — | — | — |
| | | n-Tetradecane | — | — | — | — | — | — | — | — |
| | (B) | Sodium di(2-ethylhexyl) sulfosuccinate | 12.0 | 15.0 | 10.0 | 11.2 | 11.6 | 11.4 | 11.4 | 11.4 |
| | (C) | Sorbitan trioleate | 3.0 | 5.0 | 5.0 | 4.7 | 4.3 | 3.8 | 3.8 | 3.8 |
| | (D) | Water | 5.2 | 5.2 | 10.0 | 15.0 | 20.0 | 5.0 | 5.0 | 5.0 |
| Compounding ratio | | (B)/(C) | 4.0 | 3.0 | 2.0 | 2.4 | 2.7 | 3.0 | 3.0 | 3.0 |
| Total compounding amount | | (B) + (C) | 15.0 | 20.0 | 15.0 | 15.9 | 15.9 | 15.2 | 15.2 | 15.2 |
| Turbidity | | | A | A | A | A | A | A | A | A |

TABLE 10

| | | | Example 40 | Example 41 | Example 42 | Example 43 | Example 44 | Example 45 |
|---|---|---|---|---|---|---|---|---|
| Compounding amount (% by mass) | (A) | n-Decane | — | — | — | — | — | — |
| | | n-Octane | — | — | — | — | — | — |
| | | n-Nonane | — | — | — | — | — | — |
| | | n-Undecane | — | — | — | — | — | — |
| | | n-Tridecane | 79.8 | — | — | — | — | — |
| | | n-Tetradecane | — | 79.8 | — | — | — | — |
| | | isododecane | — | — | 83.1 | 79.8 | 75.6 | 67.2 |
| | (B) | Sodium di(2-ethylhexyl) sulfosuccinate | 11.4 | 11.4 | 11.9 | 11.4 | 10.8 | 9.6 |
| | (C) | Sorbitan trioleate | 3.8 | 3.8 | 4.0 | 3.8 | 3.6 | 3.2 |
| | (D) | Water | 5.0 | 5.0 | 1.0 | 5.0 | 10.0 | 20.0 |
| Compounding ratio | | (B)/(C) | 4.0 | 3.0 | 3.0 | 3.0 | 3.0 | 3.0 |
| Total compounding amount | | (B) + (C) | 15.2 | 15.2 | 15.9 | 15.2 | 14.4 | 12.8 |
| Turbidity | | | A | A | A | A | A | A |

TABLE 11

| | | | Example 46 | Example 47 | Example 48 | Example 49 | Example 50 | Example 51 | Example 52 | Example 53 |
|---|---|---|---|---|---|---|---|---|---|---|
| Compounding amount (% by mass) | (A) | n-Decane | 79.8 | 79.8 | 79.8 | 79.8 | — | — | — | — |
| | | n-Tetradecane | — | — | — | — | 79.8 | 79.8 | 79.8 | 79.8 |
| | (B) | Sodium di(2-ethylhexyl) sulfosuccinate | — | — | — | — | — | — | — | — |
| | | Petroleum sulfonate | 11.4 | 11.4 | — | — | 11.4 | 11.4 | — | — |
| | | Turkey-red oil | — | — | 11.4 | 11.4 | — | — | 11.4 | 11.4 |
| | (C) | Sorbitan trioleate | — | — | — | — | — | — | — | — |
| | | Polyoxyethylene-polyoxypropylene block copolymer | 3.8 | — | 3.8 | — | 3.8 | — | 3.8 | — |
| | | Polyoxyethylene-polyoxypropylene alkyl ether | — | 3.8 | — | 3.8 | — | 3.8 | — | 3.8 |
| | (D) | Water | 5.0 | 5.0 | 5.0 | 5.0 | 5.0 | 5.0 | 5.0 | 5.0 |
| Compounding ratio | | (B)/(C) | 3.0 | 3.0 | 3.0 | 3.0 | 3.0 | 3.0 | 3.0 | 3.0 |
| Total compounding amount | | (B) + (C) | 15.2 | 15.2 | 15.2 | 15.2 | 15.2 | 15.2 | 15.2 | 15.2 |
| Turbidity | | | A | A | A | A | A | A | A | A |
| Saturated water content (% by mass) | | | 10 | 10 | 10 | 10 | 10 | 10 | 10 | 10 |
| Cleaning ability | | Paraffin Wax 135 | A | A | A | A | A | A | A | A |
| | | Aquawax 553 | A | A | A | A | A | A | A | A |

As listed in Table 1 to Table 3, the cleaner composition according to the present invention that contains the saturated aliphatic hydrocarbon (A) in a proportion of 60.0% by mass to 85.0% by mass, the anionic surfactant (B) in a proportion of 8.0% by mass to 15.0% by mass, the nonionic surfactant (C) in a proportion of 2.0% by mass to 5.0% by mass, and the water (D) in a proportion of 1.0% by mass to 20.0% by mass and forms the W/O microemulsion or solubilized W/O emulsion can clean a wide range of organic and inorganic contaminants. As illustrated and listed in FIG. 2 and Table 1, the volume resistivity of the cleaner composition according to the present invention is $1\times10^9$ Ω·cm or less, and even when static electricity occurs by friction or the like due to rubbing between objects to be cleaned or the like, the cleaner composition according to the present invention can reduce a danger that ignition and explosion could occur and can be used more safely. Furthermore, the cleaner composition according to the present invention stably forms the W/O microemulsion or solubilized W/O emulsion and does not reduce cleaning ability. Still furthermore, the cleaner composition according to the present invention does not contain any polar solvent and can be used for cleaning plastic or rubber materials that have low tolerance against polar solvents, and cleaning tools formed of plastic or rubber materials that have low tolerance against polar solvents can be used.

INDUSTRIAL APPLICABILITY

The cleaner composition according to the present invention can suitably be used for cleaning various kinds of articles such as components handled in various kinds of industrial fields such as automobiles, machinery, precision equipment, electrics, electronics, and optics, piping and apparatuses of various kinds of factories such as oil refinery plants and chemical plants, components obtained by disassembling automobiles, industrial machines, or the like, and metal products, resin products, and textile products used in everyday life.

The invention claimed is:

1. A cleaner composition comprising:

a saturated aliphatic hydrocarbon (A);

an anionic surfactant (B);

a nonionic surfactant (C); and water (D), wherein the cleaner composition contains the saturated aliphatic hydrocarbon (A) in a proportion of 60.0% by mass to 85.0% by mass, the anionic surfactant (B) in a proportion of 8.0% by mass to 15.0% by mass, the nonionic surfactant (C) in a proportion of 2.0% by mass to 5.0% by mass, and the water (D) in a proportion of 1.0% by mass to 20.0% by mass, forms a W/O microemulsion or a solubilized W/O emulsion, and has a volume resistivity of $1\times10^9$ Ω·cm or less, and wherein the anionic surfactant (B) is a dialkyl sulfosuccinate, and the nonionic surfactant (C) is a sorbitan fatty acid ester.

2. The cleaner composition according to claim 1, wherein the saturated aliphatic hydrocarbon (A) is a $C_{9-13}$ paraffinic hydrocarbon.

3. The cleaner composition according to claim 1, wherein the anionic surfactant (B) and the nonionic surfactant (C) are contained in a proportion of 10.0% by mass to 20.0% by mass in total, and the anionic surfactant (B) and the nonionic surfactant (C) are compounded in a ratio (mass ratio) of 2.0 to 5.0:1.

4. The cleaner composition according to claim 1, wherein the cleaner composition has a saturated water content, measured through turbidity, of 10% by mass or more.

5. The cleaner composition according to claim 1, wherein the cleaner composition contains no polar solvent.

6. The cleaner composition according to claim 2, wherein the anionic surfactant (B) and the nonionic surfactant (C) are contained in a proportion of 10.0% by mass to 20.0% by mass in total, and the anionic surfactant (B) and the nonionic surfactant (C) are compounded in a ratio (mass ratio) of 2.0 to 5.0:1.

7. The cleaner composition according to claim 2, wherein the cleaner composition has a saturated water content, measured through turbidity, of 10% by mass or more.

8. The cleaner composition according to claim 2, wherein the cleaner composition contains no polar solvent.

9. The cleaner composition according to claim 3, wherein the cleaner composition has a saturated water content, measured through turbidity, of 10% by mass or more.

10. The cleaner composition according to claim 3, wherein the cleaner composition contains no polar solvent.

11. The cleaner composition according to claim 4, wherein the cleaner composition contains no polar solvent.

* * * * *